US008662742B2

(12) United States Patent
Damasko

(10) Patent No.: US 8,662,742 B2
(45) Date of Patent: Mar. 4, 2014

(54) OSCILLATING BODY, MECHANICAL OSCILLATING SYSTEM FOR WRIST WATCHES HAVING SUCH AN OSCILLATING BODY AND WATCH HAVING SUCH AN OSCILLATING SYSTEM

(75) Inventor: Petra Damasko, Regensburg (DE)

(73) Assignee: Damasko GmbH, Barbing (DE)

( * ) Notice: Subject to any disclaimer, the term of this patent is extended or adjusted under 35 U.S.C. 154(b) by 230 days.

(21) Appl. No.: 13/198,153

(22) Filed: Aug. 4, 2011

(65) Prior Publication Data

US 2012/0087214 A1 Apr. 12, 2012

(30) Foreign Application Priority Data

| | | |
|---|---|---|
| Aug. 6, 2010 | (DE) | 10 2010 033 668 |
| Oct. 21, 2010 | (DE) | 10 2010 049 210 |
| Aug. 3, 2011 | (DE) | 10 2011 109 220 |

(51) Int. Cl.

| | |
|---|---|
| ***G04B 17/32*** | (2006.01) |
| ***G04B 17/06*** | (2006.01) |
| ***G04B 17/22*** | (2006.01) |

(52) U.S. Cl.

CPC ..... *G04B 17/063* (2013.01); *G04B 17/222* (2013.01); *G04B 17/227* (2013.01)

USPC ..... 368/171

(58) Field of Classification Search

USPC ..... 368/169–171

See application file for complete search history.

(56) References Cited

U.S. PATENT DOCUMENTS

| | | | | |
|---|---|---|---|---|
| 1,350,035 | A * | 8/1920 | Povelsen | 368/171 |
| 2,880,570 | A * | 4/1959 | Favret et al. | 368/171 |
| 6,666,575 | B2 * | 12/2003 | Scheufele | 368/127 |
| 7,661,875 | B2 * | 2/2010 | Verardo et al. | 368/171 |
| 8,100,579 | B2 * | 1/2012 | Levingston | 368/171 |
| 2010/0054090 | A1 | 3/2010 | Orny et al. | |

FOREIGN PATENT DOCUMENTS

| | | |
|---|---|---|
| CH | 343904 | 12/1959 |
| EP | 1705534 | 6/2006 |

* cited by examiner

*Primary Examiner* — Vit W Miska

(74) *Attorney, Agent, or Firm* — Welsh Flaxman & Gitler LLC

(57) ABSTRACT

Oscillating body for mechanical oscillating systems of wristwatches, having several mass weights arranged at regular angle distances around an oscillating body middle axis that respectively can rotate or swivel on the oscillating body on an axis parallel to the oscillating body axis and have a mass center of gravity that is radially offset to their axis.

9 Claims, 3 Drawing Sheets

OSCILLATING BODY, MECHANICAL OSCILLATING SYSTEM FOR WRIST WATCHES HAVING SUCH AN OSCILLATING BODY AND WATCH HAVING SUCH AN OSCILLATING SYSTEM

BACKGROUND OF THE INVENTION

The invention relates to an oscillating body, a mechanical oscillating system and to a watch with several mass weights arranged at regular angle distances around an oscillating body middle axis that respectively can rotate or swivel on the oscillating body on an axis parallel to the oscillating body axis and have a mass center of gravity that is radially offset to this axis.

Oscillating bodies for mechanical oscillating systems of watches, especially wristwatches, are known in different embodiments and they generally have the shape of a wheel or spoked wheel. To adjust the dynamic mass moment of inertia of the oscillating body and therefore the frequency of the oscillating system and the precision of the watch, mass weights are provided in the outer area of the oscillating body, the mass center of gravity of which is adjustable radially or approximately radially to the axis of the oscillating body.

It has been shown that the temperature behavior of a mechanical oscillating system can be improved very decisively in that, when a spiral spring made of silicon (mono or polycrystalline silicon) with an oxidic surface coating, for example, with a coating of silicon oxide, is used, the oscillating body is manufactured from molybdenum or a molybdenum alloy, in which case a certain disadvantage of this material consists in that fact that it is relatively difficult to machine or work with.

It is an object of the invention to present an oscillating body for mechanical oscillating systems of wristwatches that facilitates simplified manufacturing while maintaining a compact design and high stability, especially with high temperature stability.

SUMMARY OF THE INVENTION

Preferably, the oscillating body according to the invention is made of a metal material with a density greater than 10 $kg/m^3$ and a linear expansion coefficient smaller than $7\times10^{-3}$ and a Mohs hardness greater than 5, while the mass weights are manufactured from a material with a high density, for example of gold or brass.

The term "essentially" as used in the invention means deviations from the exact value by +/−10%, preferably by +/−5% and/or deviations in the form of changes that are insignificant for the function.

Further embodiments, advantages and applications of the invention are also disclosed in the following description of exemplary embodiments and the drawings. All characteristics described and/or pictorially represented, alone or in any combination, are subject matter of the invention, regardless of their being summarized or referenced in the claims. The content of the claims is also an integral part of the description.

BRIEF DESCRIPTION OF THE DRAWINGS

The invention is described in more detail below based on exemplary embodiments, in which.

DETAILED DESCRIPTION OF THE INVENTION

Figure 1:
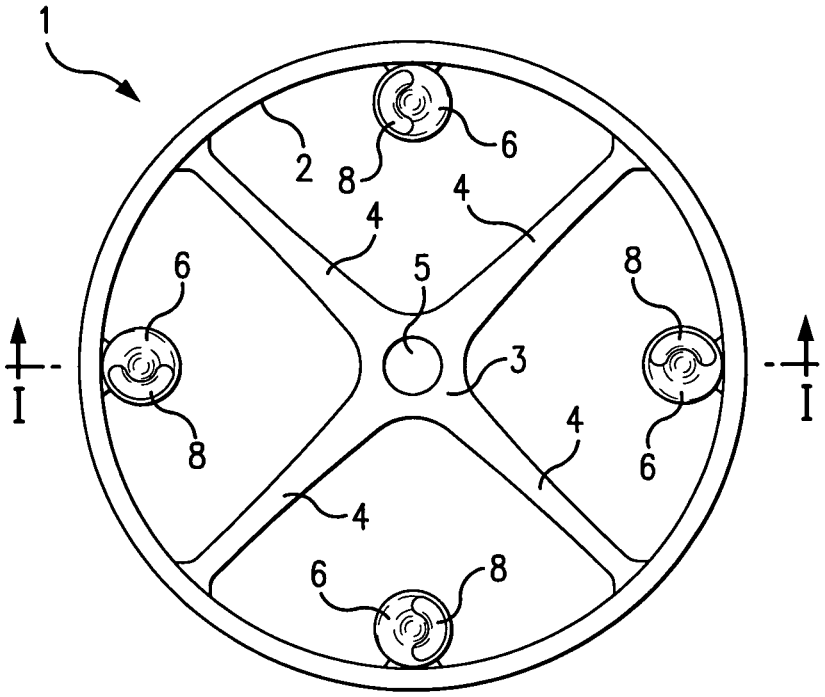
FIG. 1 shows a simplified depiction in top view of the wheel-like oscillating body of a mechanical oscillating system for wristwatches.
Figure 2:
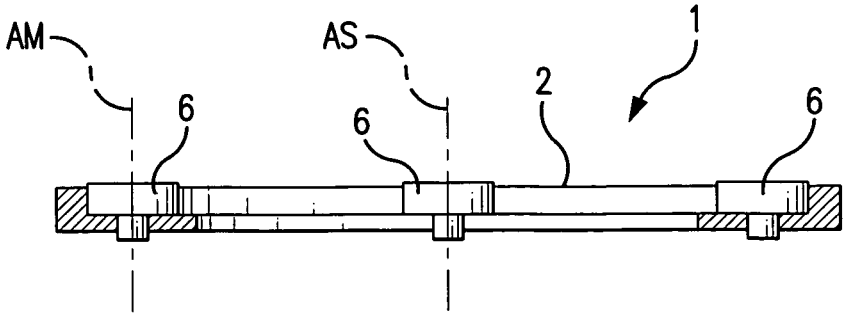
FIG. 2 shows a section corresponding to the line I-I of FIG. 1.
Figure 3:
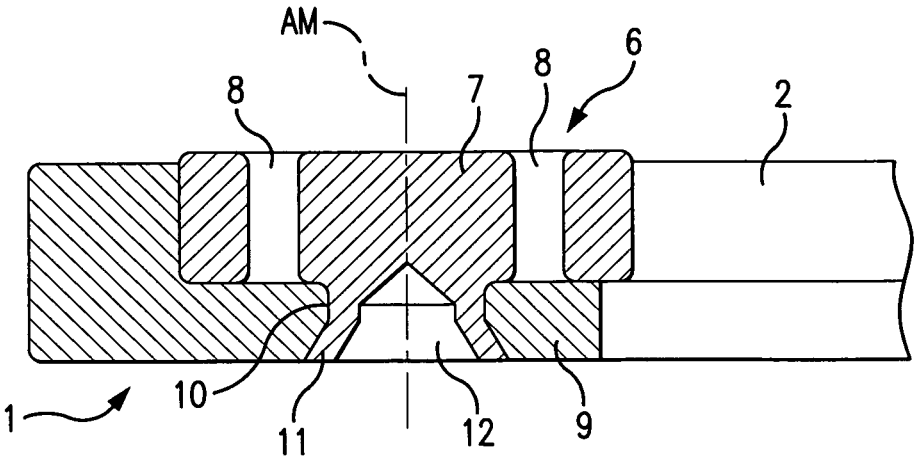
FIG. 3 shows an enlarged view of the mass weights provided on the oscillating body together with a partial view of the oscillating body.

In the drawings, a wheel-shaped oscillating body 1 of a mechanical oscillating system (balance wheel) for wristwatches is shown. The oscillating body 1 is manufactured from a stable material, for example, a metal material, preferably of molybdenum, as one piece comprising an outer section 2 concentrically enclosing the axis AS of the oscillating body 1, comprising an inner, hub-shaped section 3 and comprising four spoke-shaped ribs 4 extending radially toward axis AS and connecting the inner section 3 with the outer section 2. The section 3 is provided with an opening 5 that is axially congruent with the axis AS and serves to fasten the oscillating body 1 to a shaft, not depicted.

On the inner side of the outer section 2, identically formed mass weights 6 are distributed at even angle distances around the axis of the oscillating body respectively as a circular disk-shaped pre-formed body 7 with a circular arc-shaped groove 8 enclosing an axis AM of the respective pre-formed body 7 on an angle area smaller than 360°, i.e. in the depicted embodiment on an angle area of 180° or essentially 180°, which (groove) extends from the top side of the pre-formed body 7 to its bottom side. Due to the groove 8, the mass weights 6 have a mass center of gravity that is radially offset to the axis AM.

In assembled state, the mass weights 6, or their pre-formed bodies 7, are oriented with their axis AM parallel to the axis AS of the oscillating body 1. For mounting of the mass weights 6, which are arranged in the middle between two ribs, the outer circular ring-shaped section is designed on the inside as one piece with tab-shaped sections or tabs 9, which extend from the inside of the section 2 radially in the direction of the section 3 or the axis AS. In the area of the free end, the tabs 9 are provided with a closed bore hole 10, whose axis is oriented parallel to the axis AS. The distance of the bore holes 10 from the inner surface of the section 2 is approximately the same or slightly larger than half the diameter of the circular disk-shaped mass weights 6 or pre-formed bodies 7. All bore holes are at the same distance from the axis AS. A formed-on projection 11, which has the same outer diameter as the inner diameter of the bore hole 10, and which is cylindrical in shape on the outer surface and axially congruent with the axis AM and protrudes over the bottom side of the pre-formed body 7, engages into each bore hole 10. Each projection is provided with a bore hole 12, which is open on the face of the projection 11 facing away from the pre-formed body 7 and extends approximately into the transition area between the pre-formed body 7 and the projection 11.

By peening of the projection 11, the mass weight 6 is held on that projection 11 at the corresponding tab 9, so that the pre-formed body 7 bears with its face comprising the projection 11 and enclosing said projection against the top side of the projection 9 and with its top face facing away from the projection 11 does not protrude or protrudes only slightly, for example, with only 0 to 3% of its total axial height, over the plane of the top side of the oscillating body 1.

For the peening, each bore hole 10 is provided on the bottom side of the tab 9 facing away from the pre-formed body 7 with a phase or with a section that enlarges conically toward said bottom side, into which the projection 11 is permanently deformed radially to the axis AM so that said deformed section of the projection 11 is flush with the plane of the bottom side of the respective tab 9, i.e. it does not protrude over said bottom side. Other types of peening or fastening of the mass weights 6 to the tabs 9 are possible, for example, by permanent deformation of the respective projection 11 to form a bead overlapping the edge of the bore hole 10 on the bottom side of the respective tab 9. In any case, the peening of the mass weights 6 is effected so that they are not held reliably on the oscillating body 1, but rather can rotate on their axis AM through application of a torque for adjusting the oscillating body 1 or for setting the mass moment of inertia of said oscillating body and the respective adjustment is reliably ensured by the frictional forces acting between the tabs 9 and the mass weights 6. The bottom side of each tab 9 lies in a common plane with the bottom side of the oscillating body 1 or with the bottom side of the outer circular ring-shaped section 2.

The material used for the oscillating body 1 is a metal material with a density greater than 10 kg/m$^3$, a thermal expansion coefficient of less than $7\times10^{-6}$ and a Mohs hardness greater than 5. The thermal expansion coefficient is the linear expansion coefficient or the elongation of a length unit at a temperature increase of 1° C. in the temperature range between 0 and 100° C.

The high density produces the required mass weight and mass moment of inertia for the oscillating body 1. The high hardness ensures that the mass weights 6 after peening are held reliably on the oscillating body 1 and nevertheless that adjustment of the dynamic mass moment of inertia of the oscillating body 1 by rotating or swiveling the mass weights 6 around their axis AM is possible. The reduced thermal expansion coefficient results in high thermal accuracy of the oscillating system and therefore high accuracy of the respective wristwatch also in case of changing temperatures.

Suitable materials for the oscillating body 1 are therefore for example tungsten, molybdenum, niobium, hafnium or alloys with a high content of these metals, preferably tungsten/copper alloys with a tungsten/copper ratio of 80/20 or essentially 80/20.

The mass weights 6 are made of a material with a high density so that the mass weights 6 can be manufactured with relatively small dimensions, for example, so that the diameter of the pre-formed body 7 is approximately 1.2 units, the axial height of the pre-formed body 7 is approximately 0.35 units, the diameter of the projection 11 is approximately 0.4 units and the axial length of the projection 11 is approximately 0.2 units, where a unit is 1 mm. In the depicted embodiment, the maximum diameter of the mass weights 6 is approximately 10 to 12% of the total diameter of the oscillating body 1.

In one embodiment of the invention, the oscillating body 1 is made of copper-beryllium and the mass weights 6 are made of stainless steel.

Figure 4:
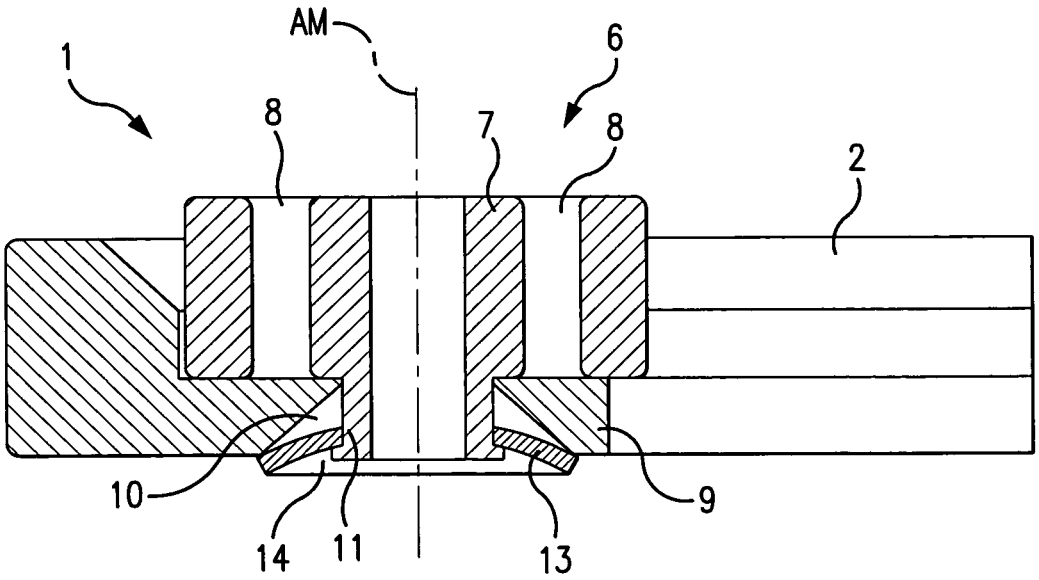
FIG. 4 shows a view similar to FIG. 3 of a further possible embodiment.
Figure 5:
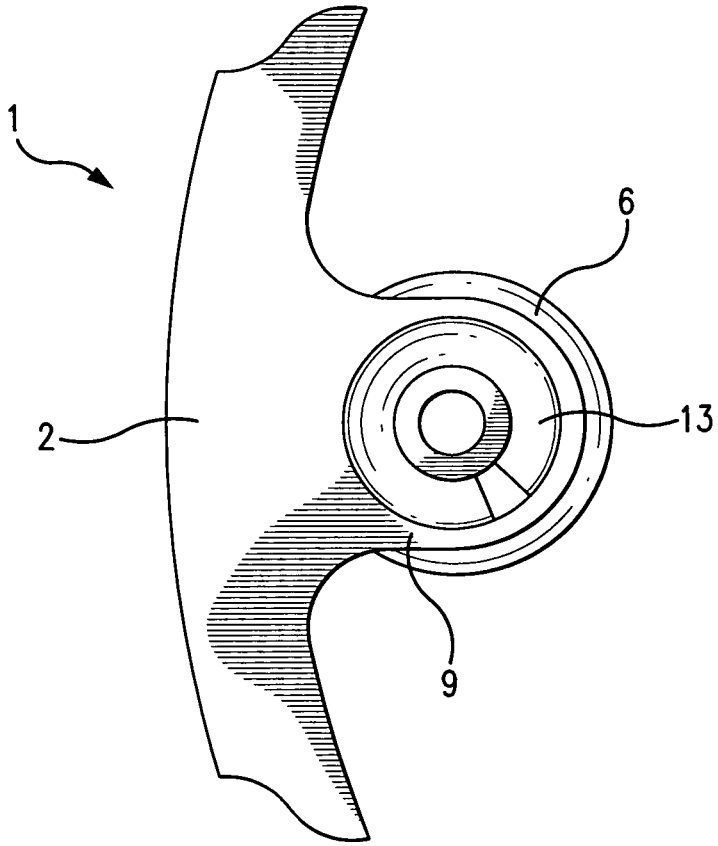
FIG. 5 shows a partial depiction in top view of the bottom side of the oscillating body.

FIGS. 4 and 5 show an embodiment in which the mass weights 6 are held in the bore hole 10 by a press fit, using a slotted clamping ring 13, i.e. they are held so that although adjustment of the moment of inertia of the oscillating body 1 is possible by rotating the mass weights 6, undesired twisting of the mass weights 6 during operation of the respective watch does not occur. The clamping rings 13 are manufactured from a suitable metal, resilient material, for example, using the so-called LIGA process. The formed-on projection 11 of the mass weight 6 is designed on its free end with a flange or collar 14 which is gripped from behind by the clamping ring 13. The bore hole 10 is designed so that it expands conically toward the bottom side of the oscillating body 1 or of the tab 9, thus forming a free space for the clamping ring 13, which bears with its outer edge against the bottom side of the oscillating body 1 in the edge area surrounding the bore hole 10, so that the mass weight 6 is pressed by the effect of the clamping ring 13 against the top side of the oscillating body 1 and therefore held with a press fit on the oscillating body 1.

An essential advantage of the oscillating system 1 consists in the fact that the oscillating body 1 has a relatively simple shape, which despite the high hardness of the material used enables simplified production. Due to the arrangement of the mass weights 6 within the outer ring-shaped section 2, practically no space for other components of the mechanical oscillating system or of the mechanical clockwork is lost due to the mass weights 6. Since the mass weights 6 can rotate or swivel on their axes AM parallel to the axis AS for adjustment of the dynamic mass moment of inertia of said oscillating body, the possibility of simplified adjustment is given, in which the grooves 8 can be used at the same time as surfaces for placing a tool used for adjustment.

The invention was described above based on an exemplary embodiment. It goes without saying that numerous modifications and variations are possible without abandoning the underlying inventive idea upon which the invention is based.

REFERENCE LIST

1 oscillating body
2 circular section of oscillating body
3 inner hub-shaped section of oscillating body
4 rib
5 opening
6 mass weight
7 pre-formed body
8 slot or recess
9 projection or tab
10 bore hole
11 projection
12 bore hole
AS middle axis of oscillating body
AM middle axis of mass weight 6

The invention claimed is:

1. An oscillating body for a mechanical oscillating system of wristwatches, comprising:

a plurality of mass weights arranged at even angle distances around a middle axis of an oscillating body, each of the plurality of mass weights has a mass center of gravity that is radially offset from an axis and can rotate or swivel on the oscillating body parallel to the middle axis of the oscillating body, wherein each of the plurality of mass weights is held by a press fit with at least one projection in a bore hole of the oscillating body formed axially congruent with the axis (AM) of each of the plurality of mass weights, and wherein the at least one projection has a same diameter as a diameter of the bore hole and each of the plurality of mass weights is held on the oscillating body by a permanent deformation of a partial section of the at least one projection to form a deformed section, and wherein the oscillating body is made of a metal material which has a density greater than 10 kg/dm$^3$.

2. The oscillating body according to claim 1, wherein each of the plurality of mass weights is held on the oscillating body by peening of the partial section of the at least one projection.

3. The oscillating body according to claim 1, wherein the oscillating body is made of a material which has a density greater than 10 kg/dm$^3$, a Mohs hardness greater than 5 and a linear expansion coefficient smaller than $7\times10^{-6}$.

4. The oscillating body according to claim 3, wherein the oscillating body is made of tungsten, molybdenum, hafnium, a tungsten/copper alloy, or a copper-beryllium alloy.

5. The oscillating body according to claim 1, wherein the plurality of mass weights are manufactured from gold, brass or stainless steel.

6. The oscillating body according to claim 1, wherein each of the plurality of mass weights are provided within the oscillating body and do not protrude, or at most protrude only minimally, over a top side and a bottom side of the oscillating body.

7. The oscillating body according to claim 1, wherein a maximum diameter of each of the plurality of mass weights is approximately 10% to 12% of a total diameter of the oscillating body.

8. The oscillating body according to claim 1, wherein the oscillating body is formed with an outer circular ring-shaped section comprising holding tabs protruding from an inner side of the outer circular rings-shaped section in a direction of the middle axis of the oscillating body and each of the plurality of mass weights are held on a holding tab by peening of the at least one projection.

9. The oscillating body according to claim 1, wherein each of the plurality of mass weights has a recess that encloses the axis of each of the plurality of mass weights on a partial circle, on an angle area between 90° and 200°.

* * * * *